United States Patent [19]

Skalski

[11] Patent Number: 4,791,744

[45] Date of Patent: Dec. 20, 1988

[54] ADJUSTABLE PRICE DISPLAY

[75] Inventor: John S. Skalski, Hanover Park, Ill.

[73] Assignee: Thomas A. Schutz & Co., Morton Grove, Ill.

[21] Appl. No.: 674,342

[22] Filed: Nov. 20, 1984

Related U.S. Application Data

[63] Continuation of Ser. No. 489,706, Apr. 29, 1983, abandoned.

[51] Int. Cl.[4] ..... G09F 3/04

[52] U.S. Cl. ..... 40/451; 40/447; 40/452; 40/524

[58] Field of Search ..... 40/447, 450, 451, 452, 40/437, 576, 472, 438, 446, 518, 524, 547, 525

[56] References Cited

U.S. PATENT DOCUMENTS

| | | | |
|---|---|---|---|
| 1,402,075 | 1/1922 | Kolk | 40/472 |
| 2,015,937 | 10/1935 | Holsman | 40/472 |
| 2,058,614 | 10/1936 | Morse | 235/71 R |
| 2,540,469 | 2/1951 | Circhey, Jr. | 40/438 |
| 3,021,140 | 2/1962 | Lushansky, Jr. | 273/271 |
| 3,064,375 | 11/1962 | Ely | 40/472 |
| 3,115,115 | 12/1963 | Lang et al. | 116/322 |
| 3,785,553 | 1/1974 | Brown | 235/80 |
| 3,939,584 | 2/1976 | Trame | 40/10 R |
| 4,095,359 | 6/1978 | Trame | 40/10 R |
| 4,216,599 | 8/1980 | Eckert | 40/451 |
| 4,220,948 | 9/1980 | Trame | 340/815.04 |

FOREIGN PATENT DOCUMENTS

| | | | |
|---|---|---|---|
| 704664 | 6/1954 | United Kingdom | 40/472 |

*Primary Examiner*—Gene Mancene
*Assistant Examiner*—Cary E. Stone
*Attorney, Agent, or Firm*—Wood, Dalton, Phillips, Mason & Rowe

[57] ABSTRACT

A rear illuminated device for displaying prices of articles is of the type that includes a housing, a light source in the rear of the housing, a front frame mounted on the housing which has a plurality of horizontal rows of windows, each of said windows being adapted to display one rear illuminated numeral of the price of an article, a film strip carrier in closely spaced cooperating relationship with each window, and each said carrier cooperating with the front frame to define a guide slot in which a section of a film strip is held effectively flat in the window, and a film strip supported on each carrier for endwise movement through a guide slot, each section of a film strip being adapted to display one of the numerals from 1 through 0 in the window. Each film strip is a continuous loop which loosely encircles the film strip carrier and is positioned entirely forward of the light source in the housing, and adjacent film strip loops are in side abutting relationship so as to be mutually confining. Each film strip carrier has a transverse slot centered between the lateral sides of a window immediately adjacent and parallel to a transverse margin of the window, and indexing holes in each film strip are aligned with a slot and so associated with the film strip sections that when a hole is moved from one end of a slot to the other it moves the film strip by one section and centers a section in the window.

13 Claims, 6 Drawing Sheets

| COLD BEER | 6-PACK | 12-PACK | 8-PACK | CASE 12 OZ | CASE 8 OZ |
|---|---|---|---|---|---|
| BUDDING | 1.89 | 3.10 | 1.95 | 9.70 | 7.40 |
| STYLER | 2.65 | 5.30 | 2.99 | 11.32 | 10.60 |
| GENERIC | 1.05 | 5.70 | 2.95 | 13.50 | 11.20 |
| MILLRUN | 1.99 | 3.98 | 5.42 | 10.86 | 9.76 |
| OLD TIME | 2.09 | 4.18 | 2.46 | 10.97 | 7.86 |
| MICHAEL | 2.55 | 4.95 | 3.29 | 9.85 | 9.15 |

21 22 23 24 25 26 2. 27

| COLD BEER | 6-PACK | 12-PACK | 8-PACK | CASE 12 OZ | CASE 8 OZ |
|---|---|---|---|---|---|
| BUDDING | 1.89 | 3.10 | 1.95 | 9.70 | 7.40 |
| STYLER | 2.65 | 5.30 | 2.99 | 11.32 | 10.60 |
| GENERIC | 1.05 | 5.70 | 2.95 | 13.50 | 11.20 |
| MILLRUN | 1.99 | 3.98 | 5.42 | 10.86 | 9.76 |
| OLD TIME | 2.09 | 4.18 | 2.46 | 10.97 | 7.86 |
| MICHAEL | 2.55 | 4.95 | 3.29 | 9.85 | 9.15 |

20

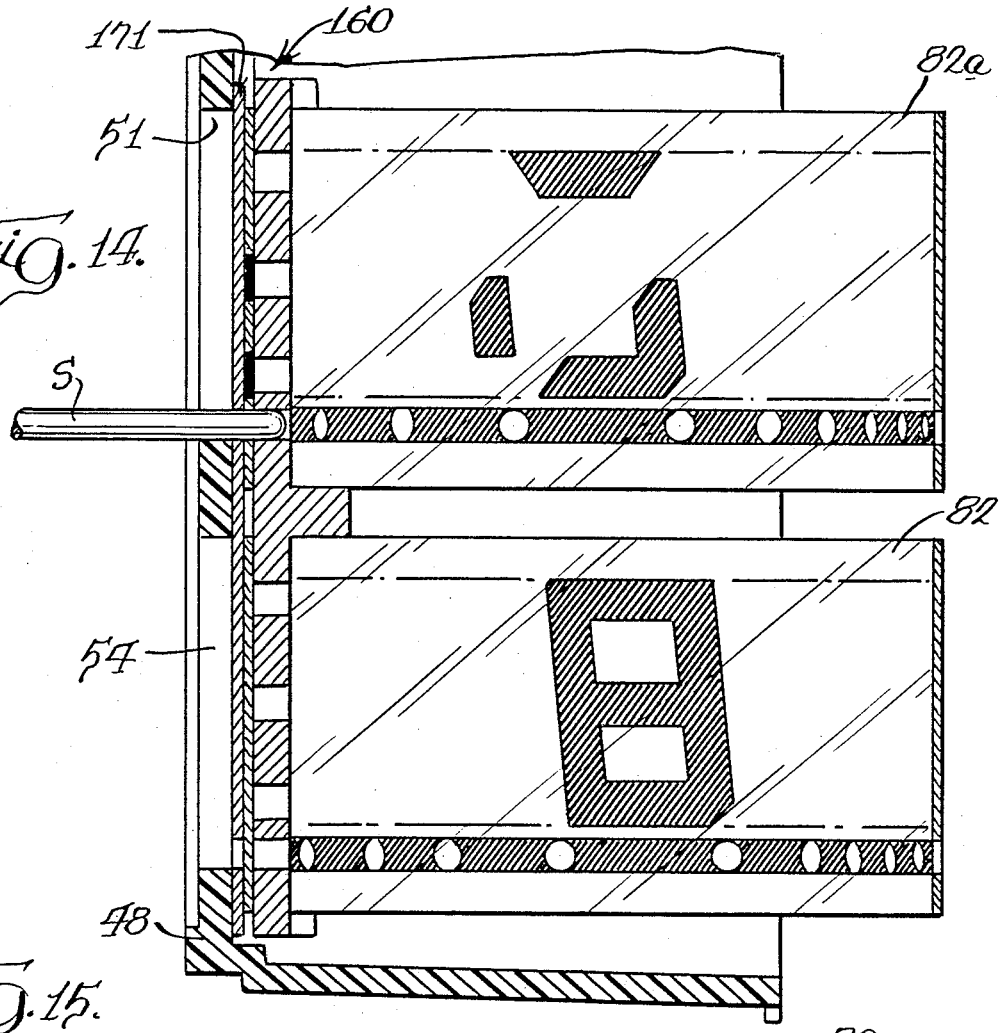
Fig. 14.
Fig. 15.
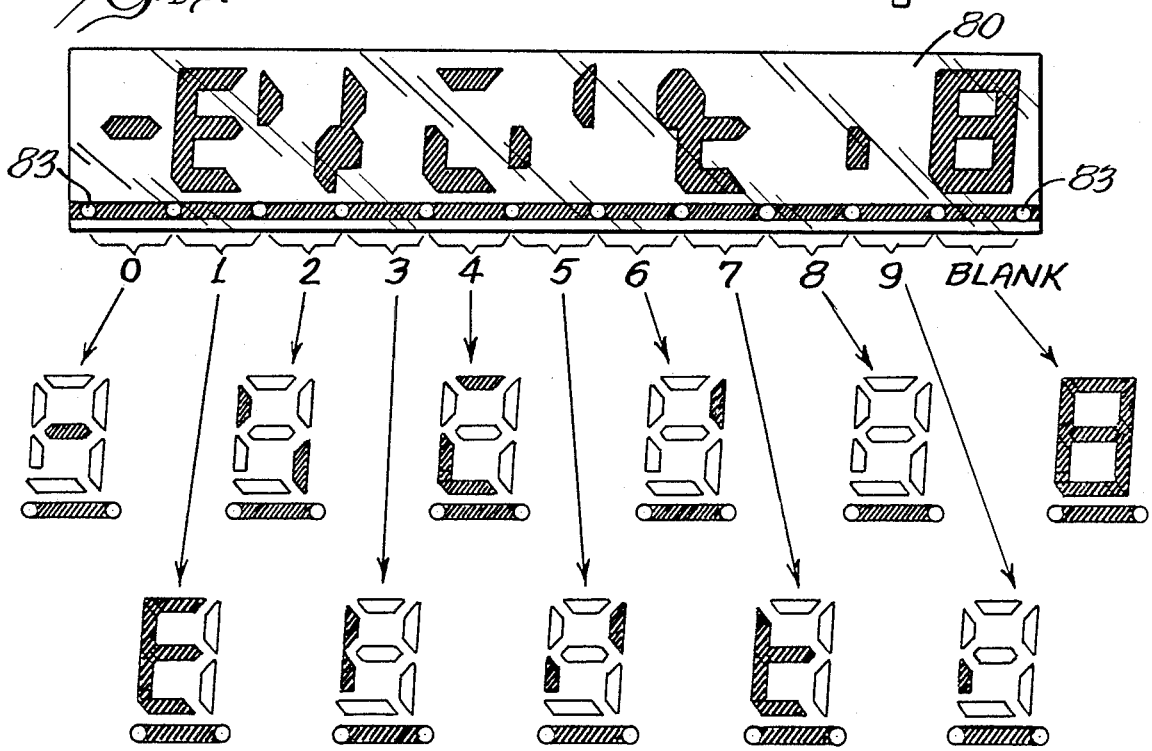

ADJUSTABLE PRICE DISPLAY

This application is a continuation-in-part continuation, of application Ser. No. 489,706, filed Apr. 19, 1983 now abandoned.

BACKGROUND OF THE INVENTION

Adjustable price displays are quite commonly used for displaying the prices of different brands of beer or cigarettes in a retail store where they are sold. U.S. Pat. Nos. 3,939,584 to Trame and 4,216,599 to Eckert, both relate to that type of device, as does Trame U.S. Pat. No. 4,220,948.

The first of the above Trame patents and the Eckert patent both disclose a carrier for a film strip. Trame discloses the use of a coiled film strip having arabic numerals. Eckert discloses the use of a film strip which has its ends projecting rearwardly from the two sides of the carrier, the strip being provided with ears at both ends so that it cannot be accidentally pulled entirely off the carrier.

Other art known to applicant which is broadly pertinent to various aspects of the present invention include U.S. Pat. Nos. 2,015,937, to Holsman, 3,021,140, to Lushansky, 3,785,553, to Brown, 2,058,614, to Morse and 3,115,115 to Lang.

SUMMARY OF THE INVENTION

The present invention is directed to a rear illuminated device for displaying prices of articles, and in one of the disclosed embodiments the invention utilizes a front frame and film strip carrier means which are of the same general type as that disclosed in U.S. Pat. No. 4,216,599.

One important feature of the present invention is that each film strip is a continuous loop which loosely encircles the film strip carrier and is positioned entirely forward of the light source in the housing.

Both the Trame type coiled film strip and the Eckert type flat film strip which extends loosely to the two sides of the film strip carrier means were designed on the assumption that it is necessary to have no obstruction between the source of illumination and the illuminated section of film strip. Applicant has found that this is not so, and as a result he is able to use a short, continuous loop of film strip that encircles the film strip carrier entirely in front of the light source, and thus eliminates any risk of the film strip being inadvertently separated from its carrier.

Another important feature of the invention is that each film strip carrier has a transverse slot laterally centered in a front frame window immediately within and parallel to a transverse margin of the window, and each film strip has indexing holes aligned with a slot, the holes being so associated with the film strip sections that when a hole is moved from one end of a slot to the other it moves the film strip by one section and centers a section in the window. The holes in the film strip are adapted to receive a stylus for moving the strip.

The foregoing construction assures very easy adjustment of the film strip from one numeral to another, and also assures that the numeral is precisely in the correct location in the window.

In different embodiments of the invention the film strip may be built either to cooperate with a figure eight pattern to simulate digital numerals of the general type seen in U.S. Pat. Nos. 4,216,599 to Eckert and 4,220,948 to Trame. Alternatively, the film strip may be provided with arabic numerals which are either clear in an opaque film strip or opaque in a clear film strip.

Where the apparatus uses the simulated digital numerals there are two embodiments of the invention. In a first embodiment the film strip carriers are translucent and the figure eight patterns are in a die cut plastic sheet that lies between the film strip carriers and the front frame. In a second embodiment the film strip carriers are opaque molded plastic with a figure eight pattern of holes formed on the mold, and in this case a plastic sheet between the film strip carriers and the front frame is transparent and may be colored if desired.

In either of the last described constructions, the transparent sheet has a slot which is in register with the slot in the film strip carrier.

THE DRAWINGS

FIG. 14 is a fragmentary sectional view on an enlarged scale taken substantially as indicated along the line 14—14 of FIG. 10;

FIG. 15 is a diagramatic view illustrating the pattern of opaque areas in a film strip for simulated digital numerals, showing how each of the patterns of opaque areas in the film strips cooperates with one of the figure eight patterns to form a designated arabic numeral or a blank space;

DETAILED DESCRIPTION OF THE INVENTION

Figure 1:
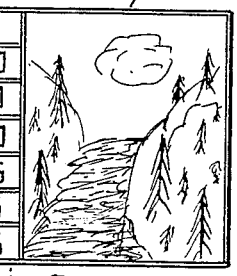
FIG. 1 is a front elevational view of a typical price display embodying the invention.

Referring to FIG. 1, an adjustable price display, indicated generally at 20, for beer is seen to have a brand display column 21 at the left, price display columns 22–26 for different types of packages, and a scenic display 27 at the right. Columns 22, 23 and 24 are for small enough packs that only a three-digit price display is required, while columns 25 and 26 may require a four-digit price display. The only individual price display areas to which reference numerals are applied are 28–33, illustrated in FIG. 2, and 34–37 illustrated in FIG. 3.

Figure 2:
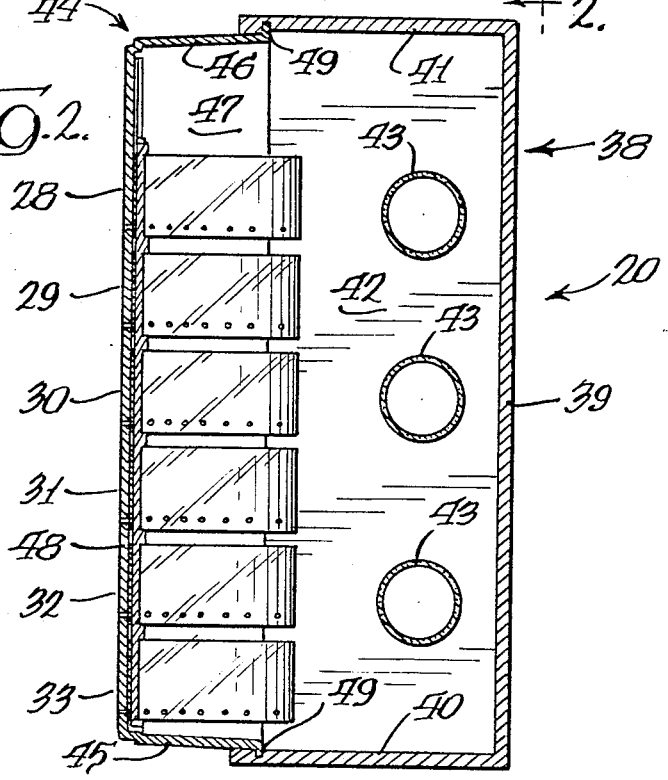
FIG. 2 is a sectional view on an enlarged scale taken substantially as indicated along the line 2—2 of FIG. 1.

Referring now to FIG. 2, the device 20 has a housing, indicated generally at 38, which consists of a rear wall 39, bottom and top walls 40 and 41, and end walls of which only the end wall 42 is seen in the drawings. A light source in the rear of the housing 38 typically consists of the necessary sockets and connections for three fluorescent tubes 43.

A front frame, indicated generally at 44, is of molded plastic and has a bottom wall 45, a top wall 46, end walls such as the illustrated end wall 47, and a front wall 48. Outturned flanges 49 on the bottom and top walls 45 and 46 and the end walls 47 may be snapped into matching slots in the respective housing walls 40, 41 and 42 by reason of the resilience of the molded plastic walls of the front frame 44.

Figure 3:
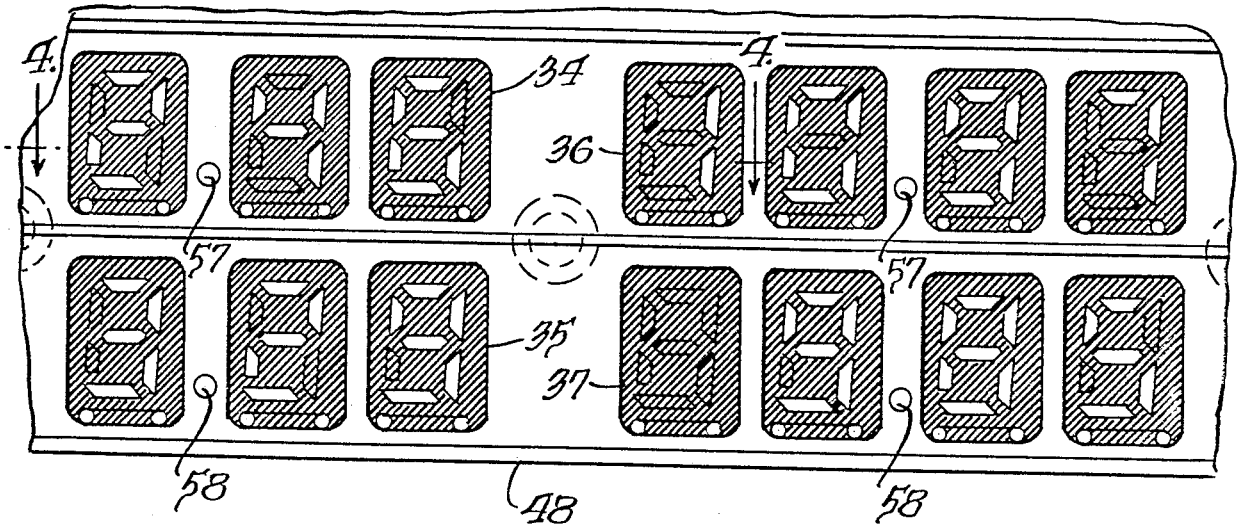
FIG. 3 is a fragmentary front elevational view on an enlarged scale illustrating the two bottom sets of the numerals in the bracketed portion of FIG. 1 as they appear in the simulated digital numerals.
Figure 7:
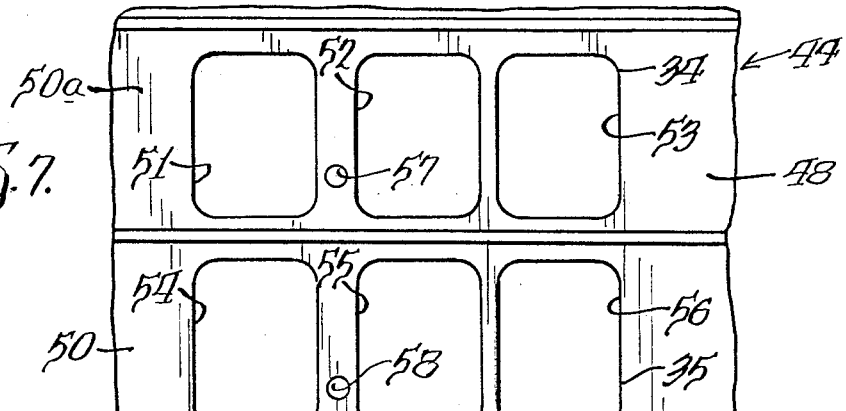
FIG. 7 is a fragmentary front elevational view of a front frame of the type which may be utilized with any of the embodiments of the invention.

Referring now to FIG. 7, the front wall 48 of the front frame 44 is seen to be provided with a plurality of horizontal rows, such as the rows 50 and 50*a* seen in FIG. 7, and each of said rows has rectangular numeral display windows such as the windows 51, 52 and 53 in the row 49, and the windows 54, 55 and 56 in the row 50. Between the windows 51 and 52, and between the windows 54 and 55, are small round holes 57 and 58 which provide a decimal point display between the numerals in the windows. As seen in FIG. 3, the decimal point displays 57 and 58 are immediately to the left of the two right hand windows in each of the numeral display areas such as the areas 34, 35, 36 and 37.

Figure 4:
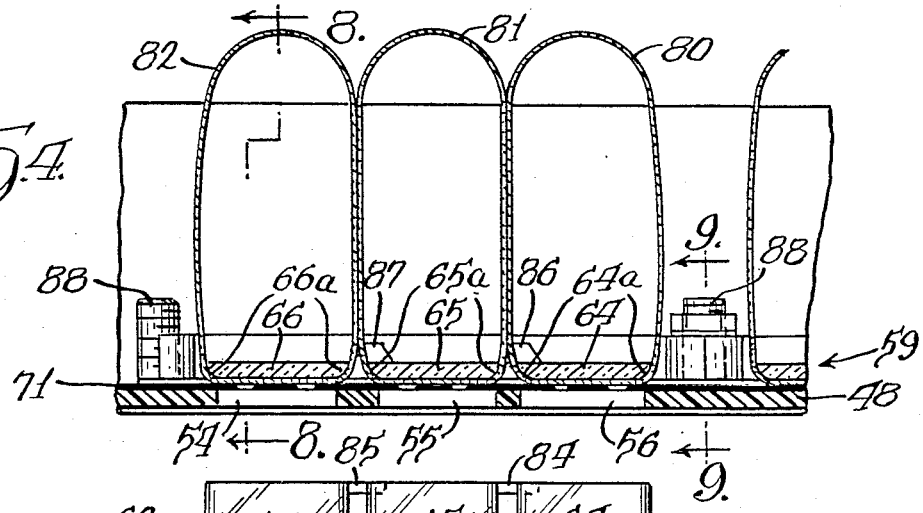
FIG. 4 is a fragmentary sectional view on an enlarged scale taken substantially as indicated along the line 4—4 of FIG. 3.
Figure 5:
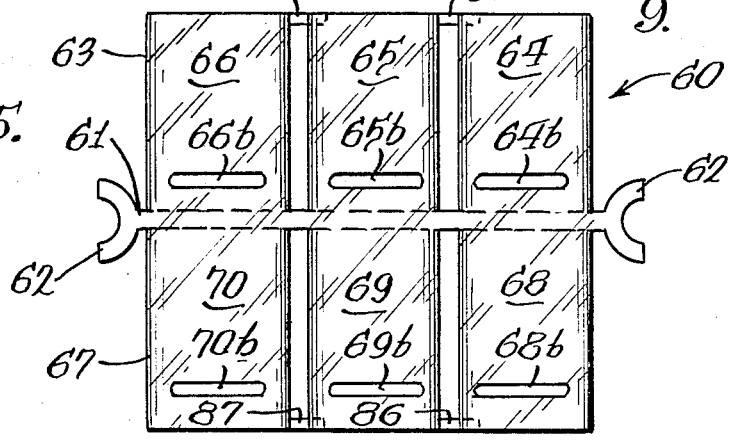
FIG. 5 is a front elevational view of a film carrier array in accordance with a first embodiment of the invention.
Figure 8:
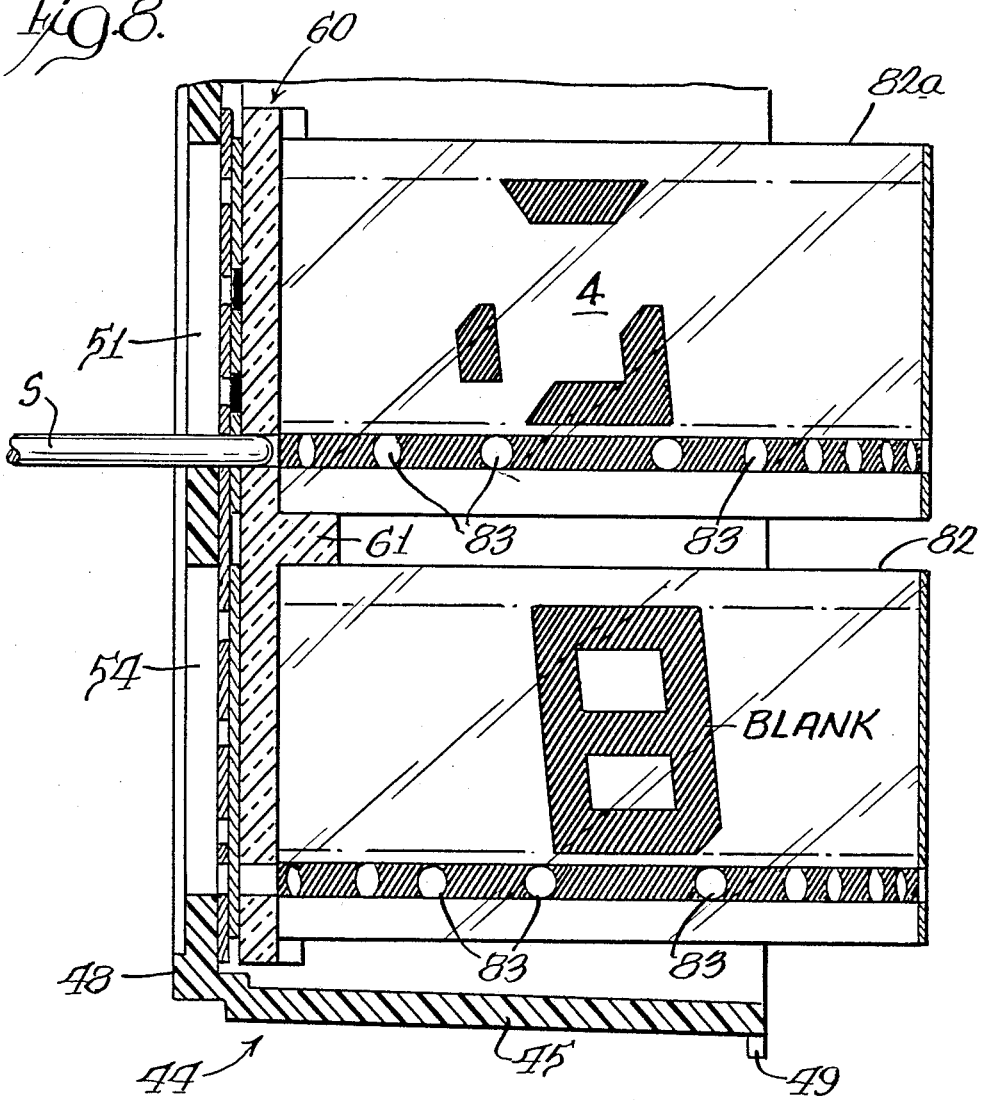
FIG. 8 is a fragmentary sectional view on an enlarged scale taken substantially as indicated along the line 8—8 of FIG. 4.

Referring now especially to FIGS. 4 and 5, film strip carrier means, indicated generally at 59 in FIG. 4, consists of a plurality of film carrier arrays, such as the array 60 seen in FIG. 5 which is for two three-digit numeral displays such as the displays 34 and 35, and also a plurality of four-digit film strip character arrays for price areas such as 36 and 37. A film strip carrier array 60 is best seen in FIGS. 5 and 8 to consist of a transverse central bar 61 that has semi-circular mounting ears 62 at its two ends. Extending upwardly from the central bar 61 is a first set 63 of three film strip carriers 64, 65 and 66; while extending downwardly from the central bar 61 is a lower set 67 of three film strip carriers 68, 69 and 70. The film strip carriers are best seen in FIG. 4 to consist of planar plates which have respective arcuate margins 64*a*, 65*a* and 66*a*.

The film strip carriers are provided with respective transverse slots 64*b*–66*b*. and 68*b*–70*b*, and each of the slots is laterally centered in the carrier in such a location that, as seen in FIG. 3, when the film strip carrier array is mounted on the front frame each of the slots is immediately within and parallel to a transverse margin of a window.

Figure 6:
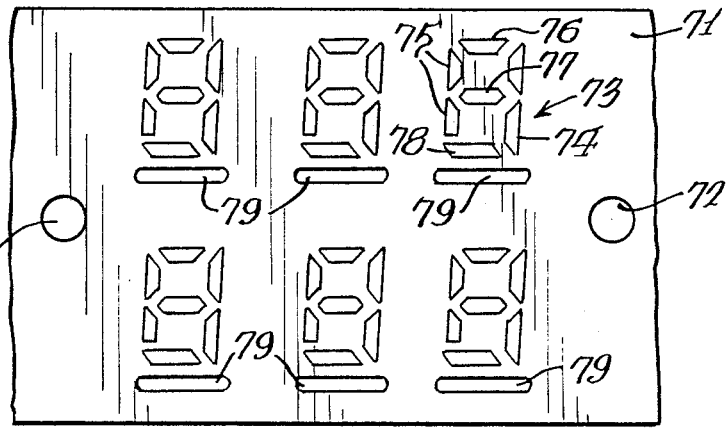
FIG. 6 is a fragmentary front elevational view of a die cut plastic sheet used in conjunction with a film carrier array of the type illustrated in FIG. 5.

Turning now to FIG. 6, a die cut plastic sheet 71 extends the entire length of the price display columns 22–26, and is provided with holes 72 that register with the semicircular mounting ears 62 on each array of film strip carriers. In addition, the plastic sheet 71 has a pattern of openings forming a numeral 8 such, for example, as the openings numbered generally 73 in FIG. 6. Each of the patterns of openings has parallel upright left and right side strips 74 and 75, and parallel top, median and bottom connecting strips numbered, respectively, 76, 77 and 78. Each of the numeral 8 patterns is so located on the plastic sheet 71 that when the sheet and the film carrier arrays are all mounted upon the front frame 44, each of the figure eight patterns is centered in the area of a film strip carrier that is immediately above the transverse slot. In addition, the plastic sheet has slots 79 that register with the slots in the strip carriers of each array.

Referring now particularly to FIGS. 4, 8 and 15, identical, continuous film strip loops, numbered respectively 80, 81 and 82 in FIG. 4, are transparent and have sections, indicated as zero through 9 and blank in FIG. 15, which cooperate with the numeral 8 pattern in the manner illustrated in FIG. 15, by blocking out selected ones of the strips 74–78 (FIG. 6) to define a specified numeral in the simulated digital numeral series.

Each of the film strips also has a line of indexing holes 83 which, when the price display is assembled, are aligned with a pair of registered slots such, for example, as 64*b* and 79, and the indexing holes are so associated with the patterns of opaque areas in the film strip sections that when a hole is moved from one end of a slot to the other it moves the film strip by one section and registers the opaque areas of a section with the strips of a numeral 8 pattern. The holes are adapted to receive a stylus S for manually moving the film strip.

Referring again to FIGS. 4 and 5, the film strip carrier array 60 has upper film strip guide bosses 84 and 85 and lower film strip guide bosses 86 and 87, each of which is fixed at one end to the planar plate of a strip carrier and has a free end spaced rearwardly of the next adjacent strip carrier as is most clearly seen in FIG. 4. Before a complete device is assembled, a film strip is mounted upon each of the film strip carriers of each film strip carrier array. Thus, the film strip 80 is mounted by moving it upwardly from below around the film strip carrier 68 with one side passing through the narrow opening between the retainer boss 86 and the carrier 69. When that film strip is fully in place its lower margin is supported upon the boss 86.

The film strip 81 is then mounted upon the carrier 69 by threading it at both sides through the gaps between the bosses 86 and 87 and the respective carriers 69 and 70. The film strip 82 is then mounted by slipping its side through the space between the boss 87 and the film carrier 70.

Similarly, film strips, of which only the strip 82*a* is illustrated in FIG. 8, are mounted upon the film strip carriers 64, 65 and 66. When the film strip loop are mounted upon the three carriers they are in side abutting relationship so as to be mutually laterally confining, as seen in FIG. 4.

Figure 9:
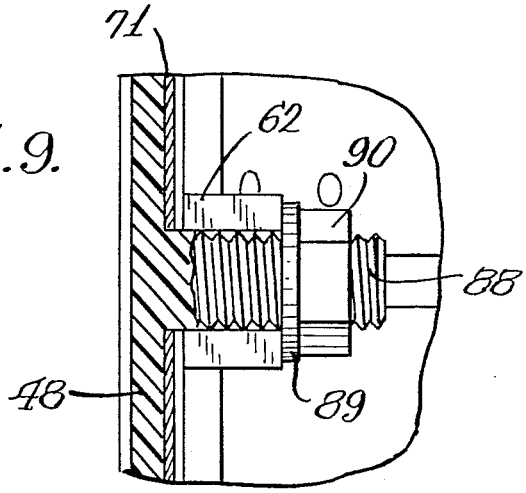
FIG. 9 is a fragmentary sectional view on an enlarged scale taken substantially as indicated along the line 9—9 of FIG. 4 to illustrate a means of mounting the film strip carrier array and the plastic sheet on the front frame.
Figure 10:
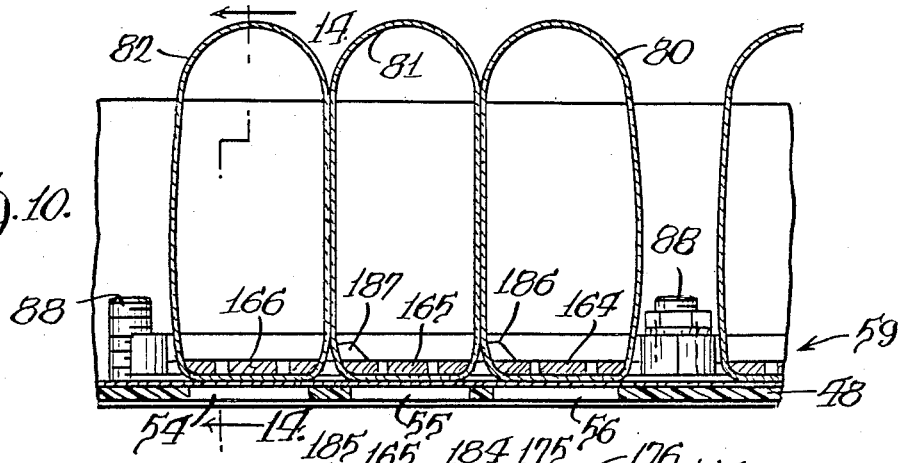
FIG. 10 is a fragmentary sectional view like FIG. 4 illustrating a second embodiment of the invention.
Figure 11:
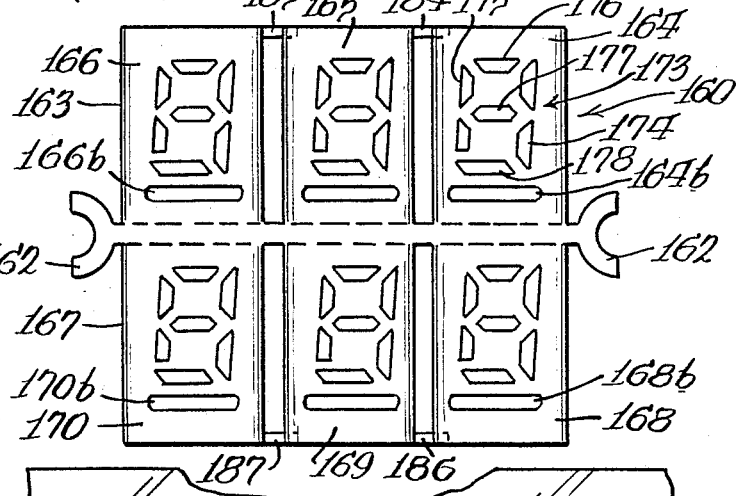
FIG. 11 is a front elevational view of a film carrier array of the type used in the embodiment illustrated in FIG. 10.
Figure 12:
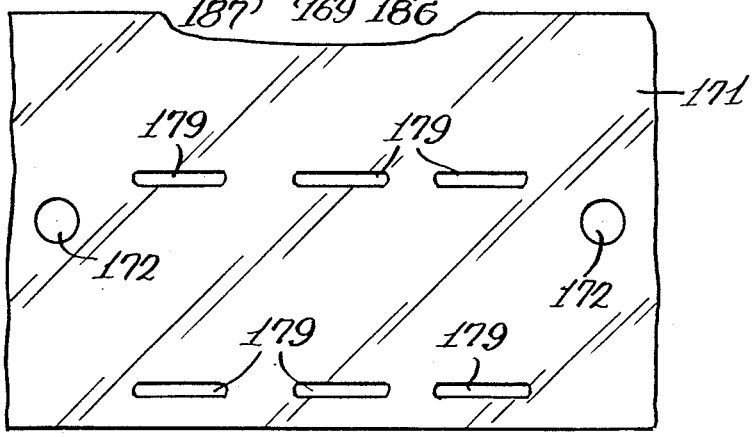
FIG. 12 is a fragmentary front elevational view of a plastic sheet of the type used with the film strip carrier array of FIG. 11.
Figure 13:
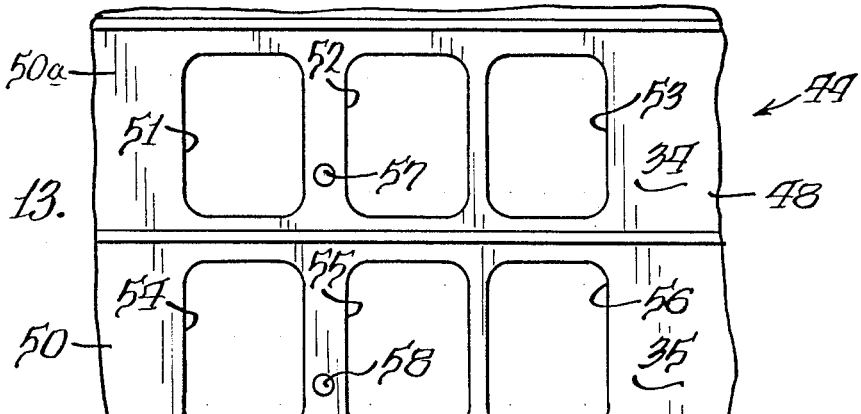
FIG. 13 is a fragmentary front elevational view of a front frame, showing that the same front frame is used in the embodiment of FIG. 4 and in the embodiment of FIG. 10.

After the film strip loops are mounted upon the film strip carrier array 60, the entire apparatus is assembled by first putting the plastic sheets 71 against the rear of the front plate 48 of the front frame 44 with the holes 72 in the plastic sheet slipped over threaded mounting studs 88 which are integral with the front frame face plate 48 and are adapted to receive both the holes 72 of the plastic sheet 71 and the semi-circular mounting ears 62 of the film strip carrier array 60. As best seen in FIG. 9, the sheet 71 is then flat against the back of the front frame face plate 48 and overlain by the semi-circular ears. 62 so that both may be held in place by washers 89 and nuts 90 on the studs 88.

After all the film strip carrier arrays for an entire display have been mounted upon the front frame in the manner just described, the entire front frame with the assembled strip carrier arrays and plastic sheet is snapped into the front of the housing 38.

Referring now to FIGS. 10–14 for a second embodiment of the device, it is seen that the only differences between the first and second embodiments are that in the first embodiment the numeral 8 patterns are in the plastic sheet 71 and the film carrier arrays are translucent; while in the second embodiment the numeral 8 patterns are holes molded in a film strip carrier array 160 which is made of opaque plastic, while a plastic sheet 171 is transparent and has only mounting holes 172 and slots 179 formed in it. Accordingly, in FIGS. 10 and 14 all the reference numerals for the front frame components and the film strips are identical with those used in FIGS. 4–8.

The numeral 8 pattern of openings in each film strip carrier is identical with the patterns in the plastic sheet 71, and the mounting bosses and slots of the film strip carrier array 160 are identical with those in the film strip carrier 60, so all those parts will be numbered as in FIGS. 5 and 6 but one hundred numbers higher in each case.

Figure 16:
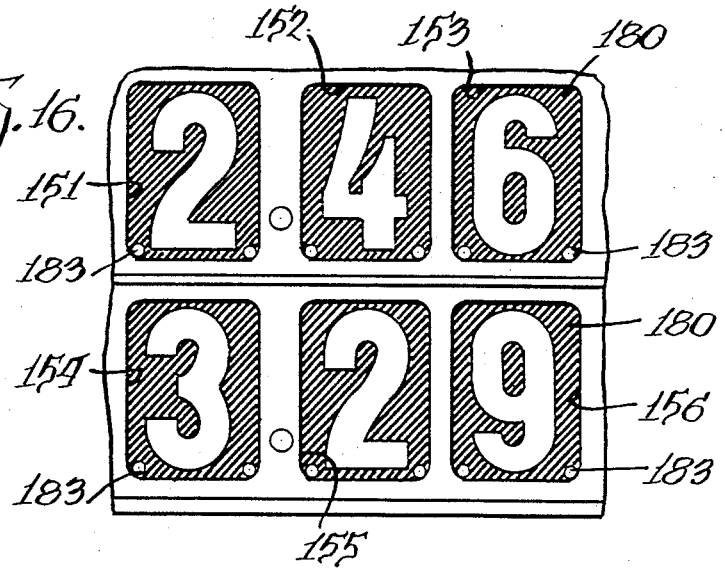
FIG. 16 is a fragmentary front elevational view illustrating a display of arabic numerals for the same two prices that are illustrated in simulated digital form in the left hand part of FIG. 3.
Figure 17:
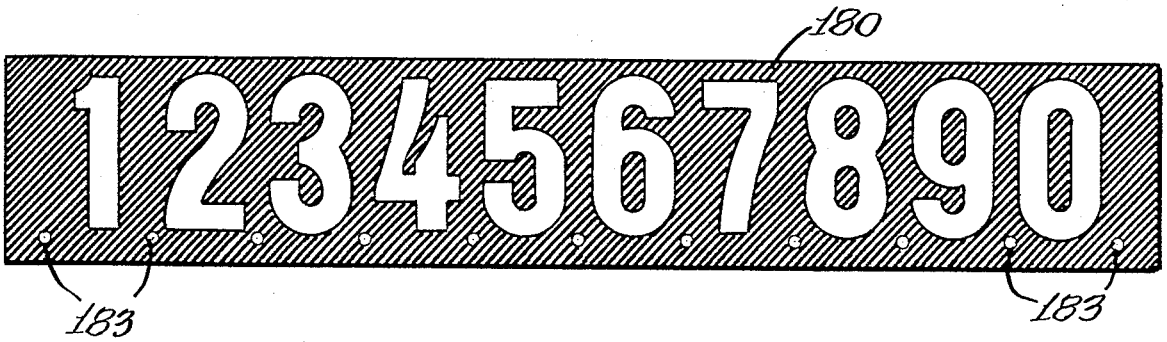
FIG. 17 is a front elevational view of an opaque film strip with transparent arabic numerals.

In an embodiment of FIGS. 16 and 17 film strips 180 are used which are illustrated as opaque with transparent arabic numerals 1 through zero. The film strip 180 is provided with indexing holes 183 which are so spaced that they function precisely as do the indexing holes 83 of the film strip 80. Thus, when a hole 183 is manually moved by a stylus S from one end of a slot to the other it moves the strip from a position with one numeral centered in a window of the front frame to a position with the next adjacent numeral centered in the front frame. If desired, of course, the film strip may be transparent and the numerals opaque.

When the film strip of FIG. 17 is used, the display device must be assembled with a translucent film strip carrier array 60 and with a transparent plastic sheet 171.

Because the numerals of the film strip 180 are larger than are the numerals formed by the digital number strip 80, display windows 151 to 156 are correspondingly larger as seen in FIG. 16.

It is seen that when either embodiment of the invention is assembled, each film strip carrier cooperates with the front frame at the upright sides o a window to define a guide slot for the film strip, and the vertical dimensions of the guide slot and of the film strip are such that the film strip makes an easy, endwise sliding fit in the guide slot.

As is clearly shown in FIGS. 2, 8, 14, 15 and 17, each entire film strip is of uniform width so that it may be moved through the guide slot continuously in either direction and stopped in a position to display any desired numeral in the window.

In any display, the light transmitting parts of the display may be of any desired color, so as to provide different visual appearances.

The foregoing detailed description is given for clearness of understanding only and no unnecessary limitations should be understood therefrom, as modifications will be obvious to those skilled in the art.

I claim:

1. In a rear illuminated device for displaying prices of articles, said device including a housing, a light source in the rear of the housing, a front frame mounted on the housing which has a plurality of horizontal rows of windows, each of said windows being adapted to display one rear illuminated numeral of the piece of an article, film strip carrier means mounted in the housing, there being a film strip carrier in closely spaced cooperating relationship with each window, and each said carrier cooperating with the front frame to define a guide slot in which a section of a film strip is held effectively flat in the window, and a film strip supported on each carrier for endwise movement through a guide slot, each section of film strip being adapted to display one of the numerals from 1 through 0 in the window, the improvement comprising:

each film strip carrier has a transverse slot laterally centered in a window immediately within and parallel to a transverse margin thereof;

and each film strip ha indexing holes aligned with one of said transverse slot,, said holes being so associated with the film strip sections that when a hole is moved from one end of said one of said transverse slots to the other it moves the film strip by one section and centers a section in the window, said holes being adapted to receive a stylus for moving the film strip.

2. The improvement of claim 1 which includes a plastic sheet between the front frame and the film strip carrier means, so the faces of the film strips bear against said plastic sheet, and there being slots in said plastic sheet in register with all the slots in the film strip carriers.

3. The improvement of claim 1 in which each film strip carrier comprises a planar plate with arcuate lateral margins, a right hand carrier a center carrier and a left hand carrier are immediately adjacent one another, and each film strip is a loop on one of said carriers, said loops on said right hand carrier, said center carrier and said left hand carrier being in side abutting relationship so as to be mutually laterally confining.

4. The improvement of claim 1 which includes a plastic sheet between the front frame and the film strip carrier means, so the faces of the film strips bear against said plastic sheet.

5. The improvement of claim 4 in which each film strip carrier comprises an opaque planar plate with a pattern of openings forming a numeral 8 that has parallel upright left and right side strips and parallel top, median and bottom connecting strips, each film strip is transparent and has in each section a pattern of opaque areas that may be positioned to block out selected ones of the strips in a numeral 8 to define one of the numerals from 1 through zero, and the plastic sheet is transparent.

6. The improvement of claim 4 in which each film strip carrier comprises a translucent planar plate, the plastic sheet is opaque and has a pattern of openings forming a numeral 8 that has parallel upright left and right side strips and parallel top, median and bottom connecting strips, each film strip is transparent and has in each section a pattern of opaque areas that block out selected ones of the strips in a numeral 8 to define one of the numerals from 1 through zero.

7. The improvement of claim 4 in which each film strip carrier comprises a translucent planar plate, the plastic sheet is transparent, and each film strip section has an arabic numeral centered in it.

8. In a rear illuminated device for displaying prices of articles, said device including a housing, a light source in the rear of the housing, a front frame mounted on the housing which has a plurality of horizontal rows of windows, each of said windows being adapted to display one rear illuminated numeral of the price of an article, film strip carrier means mounted in the housing, there being a film strip carrier in closely spaced cooperating relationship with each window, and each said carrier cooperating with the front frame to define a guide slot in which a section of a film strip is held effectively flat in the window, and a film strip supported on each carrier for endwise movement through a guide slot, each section of a film strip being adapted to display one of the numerals from 1 through 0 in the window, the improvement comprising:

each film strip carrier comprises a translucent planar plate, an opaque plastic sheet is mounted between the front frame and the film strip carrier means with the front faces of the film strips bearing against it and has a pattern of openings forming a numeral 8 that has parallel upright left and right side strips and parallel top, median and bottom connecting strips, and each film strip is transparent and has in each section a pattern of opaque areas that block out selected ones of the strips in a numeral 8 to define one of the numerals from 1 through 0.

9. The improvement of claim 8 in which each film strip is a continuous loop which loosely encircles the film strip carrier and is positioned entirely forward of the light source in the housing.

10. The improvement of claim 8 which includes registered transverse slots in the plastic sheet and in each film strip carrier centered between the side margins of a window immediately within and parallel to a transverse margin thereof, the lengths of said registered slots bearing a predetermined relationship to the widths of said numeral 8 patterns, and indexing holes in each film strip aligned with said slots, said indexing holes being so associated with the patterns of opaque areas in the film strip sections that when a hole is moved from one end of a slot to the other it moves the film strip by one section and registers the opaque areas of a section with the strips of a numeral 8, and said holes being adapted to receive a stylus for moving the fim strip.

11. In a rear illuminated device for displaying prices of articles, said device including a housing, a light source in the rear of the housing, a front frame mounted on the housing which has a plurality of horizontal rows of windows, each of said windows being adapted to display one rear illuminated numeral of the price of an article, film strip carrier means mounted in the housing, there being a film strip carrier in closely spaced cooperating relationship with each window, and each said carrier cooperating with the front frame to define a guide slot in which a section of a film strip is held effectively flat in the window, and a film strip supported on each carrier for endwise movement through a guide slot, each section of a film strip being adapted to display one of the numerals from 1 through 0 in the window, the improvement comprising:

a transparent plastic sheet is mounted between the front frame and the film strip carrier means with the front faces of the film strips bearing against it, each film strip carrier comprises an opaque planar plate with a pattern of openings forming a numeral 8 that has parallel upright left and right side strips and parallel top, median and bottom connecting strips, and each film strip is transparent and has in each section a pattern of opaque areas that may be positioned to block out selected ones of the strips in a numeral 8 to define one of the numerals from 1 through 0.

12. The improvement of claim 11 which includes registered transverse slots in the plastic sheet and in each film strip carrier centered between the side margins of a window immediately within and parallel to a transverse margin thereof, the lengths of said registered slots bearing a predetermined relationship to the widths of said numeral 8 patterns, and indexing holes in each film strip aligned with said slots, said indexing holes being so associated with the patterns of opaque areas in the film strip sections that when a hole is moved from one end of a slot to the other it moves the film strip by one section and registers the opaque areas of a section with the strips of a numeral 8, and said holes being adapted to receive a stylus for moving the film strip.

13. The improvement of claim 11 in which each film strip is a continuous loop which loosely encircles the film strip carried and is positioned entirely forward of the light source in the housing.

* * * * *